United States Patent [19]
Bleckmann
[11] 4,357,523
[45] Nov. 2, 1982

[54] ELECTRICAL HEATING MEANS FOR COOKERS OR HOT PLATES

[76] Inventor: Ingo Bleckmann, Ignaz-Rieder-Kai 11, A-5020 Salzburg, Austria

[21] Appl. No.: 238,670

[22] Filed: Feb. 27, 1981

[30] Foreign Application Priority Data

Feb. 29, 1980 [DE] Fed. Rep. of Germany ..... 3007806

[51] Int. Cl.³ ..... H05B 3/68

[52] U.S. Cl. ..... 219/464; 219/358; 219/374; 219/461; 219/462

[58] Field of Search ..... 219/358, 374, 458, 460, 219/461, 462, 464, 467, 400, 347

[56] References Cited

U.S. PATENT DOCUMENTS

| | | | |
|---|---|---|---|
| 1,855,507 | 4/1932 | Bathrick | 219/461 |
| 1,910,700 | 5/1933 | Leban | 219/462 |
| 2,518,015 | 8/1950 | Jeffrey | 219/464 X |
| 3,346,720 | 10/1967 | Siegla | 219/464 |
| 3,612,828 | 10/1970 | Siegla | 219/464 |
| 3,797,375 | 3/1974 | Cerola | 99/340 |
| 4,164,642 | 8/1979 | Ebert | 219/358 |
| 4,243,874 | 1/1981 | Fischer | 219/467 |

FOREIGN PATENT DOCUMENTS

| | | | |
|---|---|---|---|
| 361768 | 10/1922 | Fed. Rep. of Germany . | |
| 385493 | 12/1923 | Fed. Rep. of Germany . | |
| 554103 | 7/1932 | Fed. Rep. of Germany . | |
| 607298 | 12/1934 | Fed. Rep. of Germany | 219/464 |
| 693516 | 7/1940 | Fed. Rep. of Germany . | |
| 961737 | 4/1957 | Fed. Rep. of Germany . | |
| 1128625 | 4/1962 | Fed. Rep. of Germany . | |
| 2130373 | 1/1972 | Fed. Rep. of Germany . | |
| 2437026 | 2/1976 | Fed. Rep. of Germany . | |
| 2500586 | 7/1976 | Fed. Rep. of Germany . | |
| 212449 | 3/1924 | United Kingdom . | |
| 246604 | 2/1926 | United Kingdom . | |
| 1133468 | 11/1968 | United Kingdom . | |

*Primary Examiner*—Volodymyr Y. Mayewsky
*Attorney, Agent, or Firm*—Fleit & Jacobson

[57] ABSTRACT

An electrical heating device for cookers and hot plates is disclosed, having a heat-resistant support member disposed below a heat-radiation transmitting plate, in particular, a glass-ceramic plate. The support member is adapted to receive at least one electric heater filament, wherein the support member is disposed within a hollow space between the heat-radiation transmitting plate and a heat-insulating layer or body. The support member is provided with holes or cut-out portions enforcing convection of the air enclosed within the hollow space, and furthermore, the heat-insulating layer being covered by a reflecting sheet or foil, so that a substantial portion of the heat radiated downwards by the heater filament is directed partially by reflection at the sheet or foil and partially by the air current passing over the sheet or foil onto the heat-radiation transmitting plate and onto a cooking or frying vessel standing thereupon.

8 Claims, 2 Drawing Figures

ELECTRICAL HEATING MEANS FOR COOKERS OR HOT PLATES

BACKGROUND OF THE INVENTION

1. Field of the Invention

The invention relates to an electrical heating means for cookers and hot plates having a heat-resistant support disposed below a heat-radiation transmitting plate, in particular a glass-ceramic plate, said support member being adapted to receive at least one electric heater filament.

2. Description of the Prior Art

Electric cookers equipped with so-called "radiation hot plates" are being used to an increasing extent. Their cooker surfaces are formed, for example, by a glass plate. Circular, square or rectangular electrical heating means, usually of different sizes, are disposed below the glass plate. The heat produced by the electrical heating means is transmitted mainly by radiation onto cooking or frying vessels placed onto the glass plate.

Examples of embodiment are known, wherein the heater filament producing the heat is placed at a definite distance from the lower side of the glass plate. A shell-shaped structure made of a heat-resistant material is secured to the lower side of the glass plate. The heater filament is placed into the bottom of the shell-shaped structure. These embodiments provide the advantage that the glass plate is not subjected directly to the relatively high temperature of the heater filament and that each heater filament irradiates a large section of the glass plate, because of the widening of the radiation cone. In this way the radiation passing through the glass plate is thus distributed. It is a disadvantage of these embodiments, however, that a relatively high proportion of the heat energy produced by the heater filament is conducted away in downward direction and therefore becomes lost. These losses adversely affect the energy requirements and, furthermore, the heater filament or spiral must be heated to a high temperature in order that the required heating power may be transferred to the cooking or frying vessel positioned on the hot plate. This high temperature appreciably shortens the life of the heater filament.

BRIEF SUMMARY OF THE INVENTION

It is the object of the invention to propose heating means of the kind described above, wherein the downward heat-flow from the heater filament, i.e. away from the glass plate, is substantially reduced. Furthermore, the filament support member is to consist of a material having poor electrical, but very good thermal conductivity, for example pressed MgO profiles, ceramics and the like. In comparison with known embodiments having the filament directly placed into the insulating material, a lowering of the temperature of the filament, having the same dimensions, by about 50° to 100° C. may thus be achieved, leading to a doubling or quadrupling of the operational life.

The present invention provides an electrical heating means for cookers and hot plates having a support member disposed below a heat-radiation transmitting plate, in particular a glass-ceramic plate, said support member being adapted to receive at least one electric heater filament, wherein said support member is disposed within a hollow space between said heat-radiation transmitting plate and a heat-insulating layer or body, said support member being provided with holes or cut-out portions enforcing convection of the air enclosed within said hollow space, and furthermore, said heat-insulating layer being covered by a reflecting sheet or foil, so that a substantial portion of the heat radiated downward by said heater filament is directed partially by reflection at said sheet or foil and partially by the air current passing over said sheet or foil onto said heat-radiation transmitting plate and onto a cooking or frying vessel standing thereupon.

In a preferred embodiment of the electrical heating means of the present invention said support member consists of a body of refractory brick, preferably of magnesite, having an H-shaped cross-section, the flanges of said body being supported at the lower side of said heat-radiation transmitting plate and at said heat-insulating layer or said reflecting sheet or foil, and the plate-shaped central web portion of said H-shaped body, which bridges said flanges, receiving said heater filament.

According to a further preferred embodiment of the electrical heating means of the present invention, the helically wound heater filament is arranged in known manner in a groove of said support member and the bottom of said groove is provided with through holes or cut-out portions through which a convective air current is drawn and directed upwards against said heat-radiation transmitting plate through said heater filament when in heated state, and furthermore, between the windings of said heater filament additional holes or cut-out portions are provided, through which the convective air current streams downwards against the sheet or foil.

BRIEF DESCRIPTION OF THE DRAWINGS

The accompanying drawings illustrate a preferred embodiment of the new electrical heating means of the present invention.

DETAILED DESCRIPTION OF A PREFERRED EMBODIMENT

Figure 1:
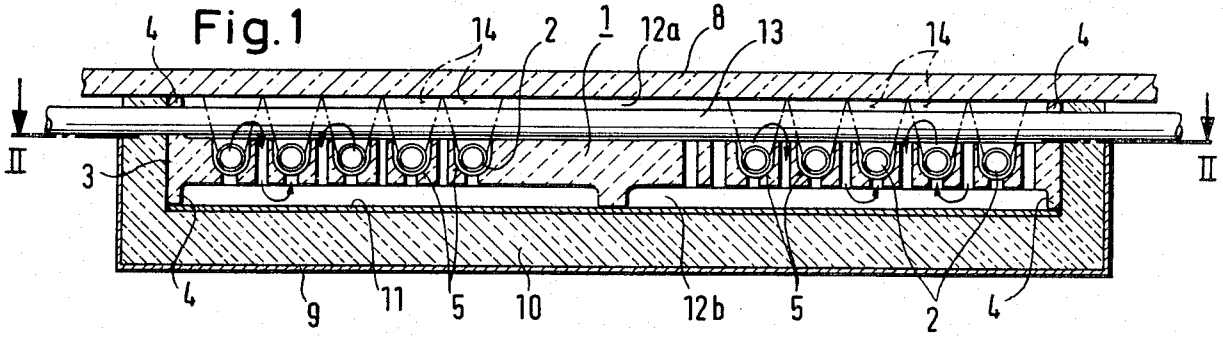
FIG. 1 is a partial vertical section through the heating means.
Figure 2:
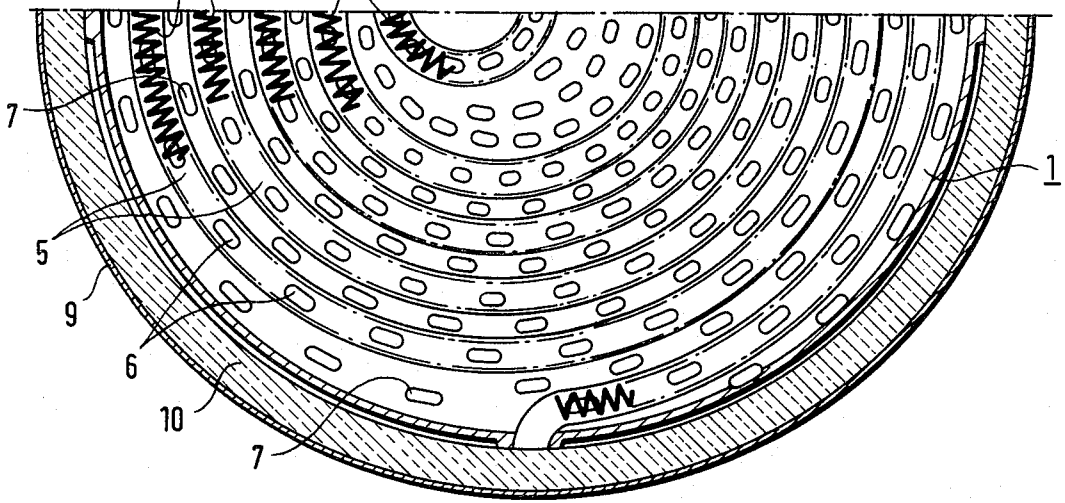
FIG. 2 is a sectional view along the line II—II in FIG. 1.

A support member 1 for a helically wound heater filament 2 consists of a refractory brick, for example, of pressed magnesite, having a H-shaped cross-section, i.e. a round or square or even rectangular plate 3 is integrally formed with flanges 4. Grooves 5 are pressed into the surface of the plate 3. Acccording to the required power stages of the plates used, the grooves may be provided with a single heater filament 2 or a plurality of heater filaments 2 to be operated in series or parallel or as a single unit.

The bottom of the groove 5 is provided with spaced through holes or slot-shaped cut-out portions 6, through which a convective air current is drawn by the heater filament 2 in heated state during operation, as is indicated by the arrows in FIG. 1. This convective air current cools the heater filament so that its temperature is about 30° to 50° C. lower in comparison with that of an embodiment using the same power but not provided with the holes or cut-out portions 6. Between the windings of the heater filament 2 further holes or cut-out portions 7 are provided, through which the convective air current may pass downwards after having given off heat to the glass-ceramic plate 8.

Furthermore, a bracket or a shell 9 is provided to support a heat-insulating layer 10 or a heat-insulating body. A radiation-reflecting sheet or foil 11, in particular an aluminium foil, is placed onto the heat-insulating body 10. The flanges 4 of the support member 1 are supported on one side by the lower side of the glass plate 8 and on the other side by the sheet or foil 11 or at the heat-insulating layer 10.

In this manner a hollow space is created, which is divided by the plate 3 into two approximately equally sized halves 12*a* and 12*b*. To achieve suitable temperature control the temperature within the hollow space 12*a*, for example, may be detected by means of a thermostat device 13 passing diagonally through the arrangement.

As in this new arrangement the heater filament 2 is disposed at a distance from plate 8, the area of intersection of the radiation cone 14 with the plate 8 is correspondingly large, so that the heat is transmitted uniformly to the cooking vessel or a pan (not shown) placed onto the plate 8 and undesired local overheating is avoided. Furthermore, this limits the thermal load on the plate 8.

The major portion of the heat radiated away in downward direction from the lower side of the plate 3 is reflected by the sheet or foil 11. Herein the hollow space 12*b* has two very important functions:

If the sheet or foil 11, for example an aluminium foil, were to be disposed directly at the lower side of the plate 3, then it would melt, because temperatures of up to 900° C. may exist at this location. The hollow space 12*b* may be of such dimensions, that the heat reflecting sheet or foil 11 attains no temperature which might be higher than its softening temperature or even its melting temperature. Now convection of air accordingly takes place on the other side, because of the cut-out portions 6, 7, thus providing a suitable balance. The convection currents may form in very differing manner, according to the temperature on the upper side of the plate. In general, the temperature at the plate 8 will be lower than the temperature at the surface of the sheet or foil 11, because of the contents of the cooking or frying vessels placed onto the hot plate. Air which has become cooler will accordingly pass downwards through the cut-out portions 7 and will cool the space 12*b*, whereafter it then again rises upwards through the other cut-out portions 6. This effect is particularly marked when the thermostat device 13 has switched off strands of the heater filament 2. Suitable comparison tests have shown that with the new embodiment the energy transfer to the contents of the cooking vessels is improved by more than 10% when compared with known embodiments. As the temperature of a heater filament having the same, usual dimensions may be lowered by about 50° C. the operational life of the heater filament 2 is approximately doubled when compared with the heater filaments of other embodiments.

What is claimed is:

1. An electrical heating means for cookers and hot plates having a heat-radiation transmitting plate, a heat-resistant support member spaced from and disposed below a portion of the heat-radiation transmitting plate, heat insulating means spaced from and disposed below a portion of said support member and having a heat reflecting surface facing said support member for reflecting heat, said support member being adapted to receive at least one electric heater filament, at least one electric heater filament disposed in said support member, said support member being disposed within a hollow space between said heat-radiation transmitting plate and said heat insulating means, said support member being provided with cut-out portions enforcing convection of air enclosed within said hollow space, said reflecting surface being disposed so that a substantial portion of the heat radiated downwards by said heater filament is directed partially by reflection at said heat reflecting surface and partially by the air current passing over said heat reflecting surface onto said heat-radiation transmitting plate and onto a vessel standing thereupon, said support member having grooves for receiving said heater filament, said heater filament being helically wound and arranged in the grooves of said support member, the bottom of said grooves being provided with the cut-out portions, through which a convective air current is drawn and directed upwards against said heat-radiation transmitting plate through said heater filament when in heated state, said support member having between the windings of said heater filament additional cut-out portions through which the convective air current streams downwards against the heat reflecting surface, said support member having a flange around the periphery thereof, an upper surface of the flange contacting a lower surface of the heat-radiation transmitting plate and a lower surface of the flange contacting said heat insulating means so that said flange encloses the space between said heat-radiation transmitting plate and said support member and the space between said support member and said heat insulating means.

2. An electrical heating means for cookers and hot plates having a heat-radiation transmitting plate, a heat-resistant support member disposed below and having a portion spaced from the heat-radiation transmitting plate, heat insulating means disposed below and having a portion spaced from said support member with a heat reflecting surface facing said support member for reflecting heat, said support member being adapted to receive at least one electric heater filament, at least one electric heater filament disposed in said support member, said support member being disposed within a hollow space between said heat-radiation transmitting plate and said heat insulating means, said support member being provided with cut-out portions enforcing convection of air enclosed within said hollow space, said reflecting surface being disposed so that a substantial portion of the heat radiated downwards by said heater filament is directed partially by reflection at said heat reflecting surface and partially by the air current passing over said heat reflecting surface onto said heat-radiation transmitting plate and onto a vessel standing thereupon, said support member having a body with an H-shaped cross-section and flanges, the flanges of said body contacting a lower side of the heat-radiation transmitting plate and said heat insulating means so as to encompass the space between said heat-radiation transmission plate and said support member and the space between said support member and said heat insulating means, the body having a plate-shaped central web portion which bridges said flanges and receives said heater filament.

3. An electrical heating means according to claim 1 or 2, wherein said heat-radiation transmitting plate is a glass-ceramic plate.

4. An electrical heating means according to claim 1 or 2, wherein said support member comprises a body of refractory brick.

5. An electrical heating means according to claim 4, wherein said support member is formed of magnesite.

6. An electrical heating means according to claim 1, wherein said support member comprises a body having an H-shaped cross section, said body having a plate-shaped central web portion extending between the peripheral flange and receiving said heater filament.

7. An electrical heating means according to claim 1 or 2, wherein said heat reflecting surface of said heat insulating means comprises a reflecting sheet.

8. An electrical heating means according to claim 1 or 2, wherein said heat reflecting surface of said heat insulating means comprises a reflecting foil.

* * * * *